United States Patent [19]

Holleis et al.

[11] 4,129,174

[45] Dec. 12, 1978

[54] ARRANGEMENT FOR ADJUSTING AND SECURING A BOTTOMLESS MOULD

[75] Inventors: Günter Holleis, Linz; Reinhard Hargassner, Leonding, both of Austria

[73] Assignee: Vereinigte Österreichische Eisen-und Stahlwerke - Alpine Montan Aktiengesellschaft, Linz, Austria

[21] Appl. No.: 757,461

[22] Filed: Jan. 7, 1977

[30] Foreign Application Priority Data

Jan. 16, 1976 [AT] Austria ..... 265/76

[51] Int. Cl.[2] ..... B22D 11/124; B22D 11/00

[52] U.S. Cl. ..... 164/443; 164/418

[58] Field of Search ..... 164/82, 83, 268, 281, 164/282, 283 R, 273 R, 280, 418, 441, 442, 447, 448, 443, 444

[56] References Cited

U.S. PATENT DOCUMENTS

| | | | |
|---|---|---|---|
| 3,166,803 | 1/1965 | Ruckstuhl | 164/283 R |
| 3,167,829 | 2/1965 | Hess et al. | 164/282 |
| 3,516,479 | 6/1970 | Kurth et al. | 164/282 |

*Primary Examiner*—Francis S. Husar
*Assistant Examiner*—John S. Brown
*Attorney, Agent, or Firm*—Brumbaugh, Graves, Donohue & Raymond

[57] ABSTRACT

An arrangement for adjusting and securing a bottomless mould to a mould lifting table in a continuous casting plant for strands with supporting and guiding paths arranged to follow the mould to support the strand at opposite sides thereof, has centering apparatus on the mould lifting table and on the mould. Part of the centering apparatus is vertically displaceable relative to the supporting and guiding paths. The mould is arranged with lateral play relative to the mould lifting table and bracing devices are provided for fixing the mould on the mould lifting table.

16 Claims, 4 Drawing Figures

ARRANGEMENT FOR ADJUSTING AND SECURING A BOTTOMLESS MOULD

BACKGROUND OF THE INVENTION

The invention relates to an arrangement for adjusting and securing a bottomless mould on a mould lifting table in a continuous casting plant, wherein supporting and guiding paths are arranged to follow the bottomless mould to support the strand on opposite sides thereof and wherein centering elements secured to the mould engage in centering-element-accommodating pieces provided on the lifting table.

In continuous casting plants, the bottomless mould united with the water box to form a structural unit is rigidly secured to a lifting table which oscillates in the direction of the mould axis for the purpose of oscillating the mould. For securing and centering the mould on the lifting table, bolts mounted on the lifting table are usually provided, which bolts engage in bores of the mould without play. In order for the inner walls of the mould to be precisely aligned with the supporting and guiding paths supporting the strand, hitherto the lifting table guiding paths, along which the lifting table is guided while oscillating, have been readjusted. In this known construction the whole lifting table weighing several metric tons and its oscillation drive must be displaced for adjusting the mould. It is difficult to readjust the lifting table guiding paths, since usually they are arranged below the casting platform and therefore are not easily accessible. Furthermore, they must be precisely adjusted after a displacement in order to assure a smooth oscillation of the lifting table.

SUMMARY OF THE INVENTION

The invention aims at avoiding these disadvantages and difficulties and has as its object to provide an arrangement for adjusting and securing a bottomless mould in a continuous casting plant, which arrangement enables a simple operation and is easily accessible. Furthermore, the construction of this arrangement is less complex than previous design and the weight to be displaced when the mould is adjusted is reduced.

According to the invention, this object is achieved in that the centering elements or the centering-element-accommodating pieces are perpendicularly displaceable relative to the supporting and guiding paths and that the mould, which is arranged with lateral play relative to the lifting table, is fixable on the lifting table by bracing means.

According to a preferred embodiment, the centering-element-accommodating pieces are designed as forks having guiding cheeks and the centering elements are designed as bolts insertable in the forks and secured between a pair of supporting plates of the water box. The diameter of the bolts corresponds to the distance between the guiding cheeks of the forks. By this configuration a further disadvantage of previously known mould fastenings is overcome, which disadvantage consists in that the mould can tilt when it is lifted off the lifting table, due to the differing lengths of the cables of the crane suspension means, whereby the centering bolts are jammed in the bores of the mould. The repairs of the bent and ripped off bolts thus cause a remarkably slow exchange of the mould. With the present invention the mould need no longer be precisely vertically aligned when installed or removed, and damage to the centering elements and centering-element-accommodating pieces due to a slanting of the mould is prevented.

For compensating thermal expansions of the mould, two forks are arranged on the lifting table with their guiding cheeks parallel to the supporting and guiding paths. The pair of supporting plates allocated to one fork is guided without play on the fork and the pair of supporting plates allocated to the second fork is guided on the fork with play.

For adjusting the mould, advantageously each fork is mounted on a sliding block, which sliding block is displaceable by means of a threaded spindle along guide rails arranged on the lifting table.

Suitably, each fork is mounted on the sliding block so as to be pivotable about a vertical axis, whereby, when the mould is put on, the forks automatically align themselves so as to correspond to the position of the bolts.

According to an advantageous embodiment, the centering elements are designed as bolts having crowned surfaces, the greatest thickness of the bolts corresponding to the distance between the guiding cheeks of the forks. Thus it is not necessary to mount the fork heads rotatably on the sliding block. In this embodiment the crowned surface of the bolts compensates for slightly inclined positions of the forks or bolts, respectively.

Advantageously, for a height adjustment of the mould, i.e. for adjusting the distance present between the mould and the beginning of the supporting and guiding path, exchangeable inserts are provided between the mould and the lifting table.

Advantageously, the mould is fixable on the lifting table by drawing anchors which penetrate brackets arranged at the periphery of the mould with radial play.

BRIEF DESCRIPTION OF THE DRAWINGS

The invention shall now be described by way of example only and with reference to the accompanying drawings, wherein.

DESCRIPTION OF EXEMPLARY EMBODIMENTS

Figure 1:
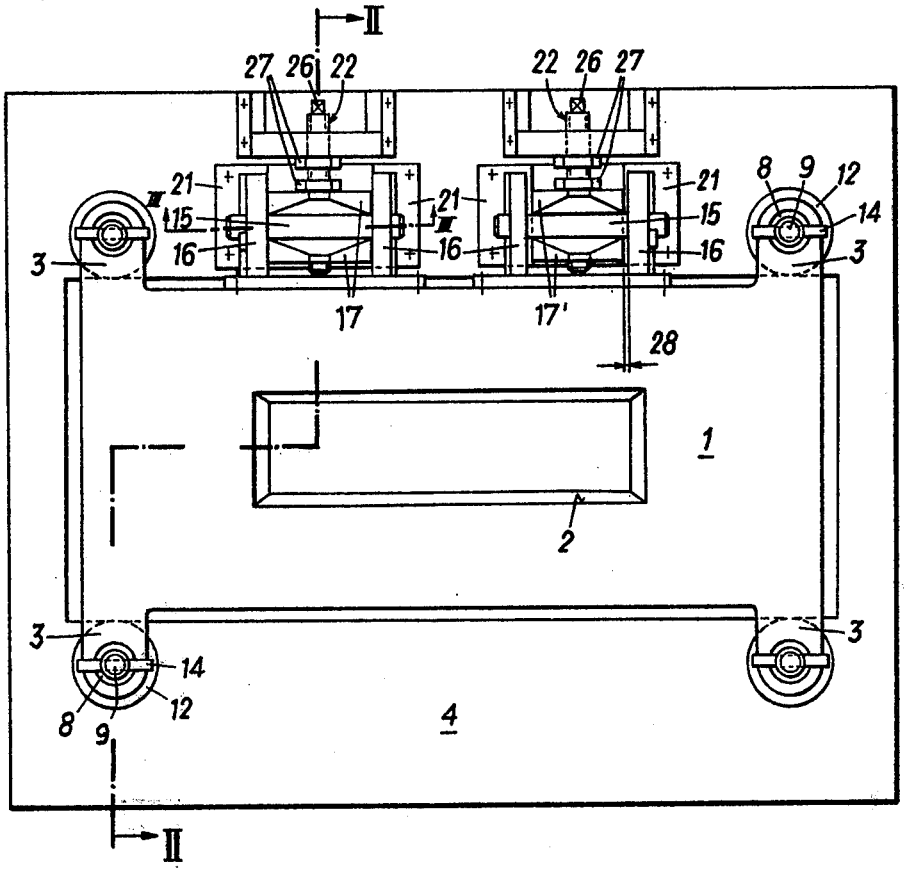
FIG. 1 is a schematic top view in the casting direction of a mould mounted on a lifting table.

By 1 a water box is denoted, in which the mould walls 2 of the bottomless mould are mounted. It forms a structural unit together with the mould walls, which unit hereafter will be referred to as the mould. The mould is supported on a lifting table 4 via four consoles 3 arranged at its corners. With its lower part it protrudes with lateral play into the frame-like lifting table 4. At the run-out side of the mould, foot rollers 5 supporting the strand are fastened. In the extraction direction of the strand, after the foot rollers, there follow the strand guiding paths 6 and 7 supporting the strand at two opposing sides. The guiding paths are stationarily mounted independent of the mould which is mounted on the lifting table and oscillates with the lifting table. The consoles 3 are provided with bores 8 which are penetrated with radial play 10 (FIG. 2) by drawing anchors or tie-rods 9 rigidly mounted on the lifting table. For adjusting the height of the mould, i.e. for adjusting the required distance 11 between the foot rollers 5 and the supporting and guiding paths 6 and 7, there are provided exchangeable spacers 12 which can be inserted between the consoles 3 and the lifting table 4. With their help, also the mould axis 13 can be vertically aligned. By means of wedges 14, which can be pushed into the drawing anchors 9, the mould is fixed on the lifting table.

On one side wall of the mould two bolts 15 are secured substantially horizontally and parallel to the supporting and guiding arcs 6 and 7 via one pair of supporting plates 16, each pair of plates carrying the bolts at the ends thereof. On the lifting table, forks 17 and 17' are arranged, and the bolts 15 can be pushed between the guiding cheeks 18 of the forks which cheeks are arranged parallel to the guiding paths. The bolts 15 have a diameter that corresponds to the distance between the guiding cheeks 18. The forks 17 and 17' are mounted to be rotatable around a vertical axis in sliding blocks 19 arranged on the lifting table. Their rotatary movement is limited by one pin 20 each. The sliding blocks are guided by guiding rails 21 secured on the lifting table perpendicular to the strand guiding paths 6 and 7. For displacing each sliding block 19 there are provided threaded spindles 22 arranged parallel to the guiding rails 21, which spindles penetrate, on the one hand, the sliding block 19 with a threaded portion 23 and, on the other hand, a counter bearing 25 mounted on the lifting table with a further threaded portion 24 whose thread ascent is opposite to that of the first threaded portion 23. For actuating the threaded spindles there are provided squares 26 arranged at their ends. With the help of safety nuts 27 the play of the thread can be eliminated. The distance between the supporting plates of the pairs 16 of supporting plates is selected in such a manner that one pair of supporting plates embraces the fork 17 without play and one laterally embraces the fork 17' with play 28. As a result changes in the length of the mould and lifting table caused by temperature differences can be compensated. Furthermore it also becomes possible to pivot the mould about its axis 13.

For putting the mould, onto the lifting table, the mould which has been raised to above the lifting table by a crane suspension means, is lowered until the consoles 3 rest on the spacers 12. By choosing spacers 12 of different heights, the distance 11 between the mould and the strand guiding paths 6 and 7 as well as the position of the axis 13 of the mould can be corrected. Slanted ends of the forks (17 and 17') and of the supporting plates 16 enable an easy insertion of the bolts 15 into the fork openings. Consequently, slanted positions of the mould do not constitute an impediment. When the mould has touched down, the alignment of the foot rollers 5 with the supporting and guiding paths 6 and 7 is adjusted by rotating the spindles 22, i.e. the mould is displaced until the distance 30 (FIG. 2) has been eliminated. Thereupon the mould is fixed on the lifting table with the help of wedges 14 and the play of the threaded spindles 22 is eliminated with the help of nuts 27.

Figure 4:
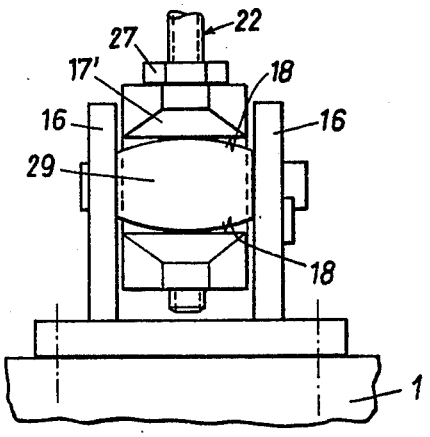
FIG. 4 is a partial view according to FIG. 2 of a further embodiment.
Figure 2:
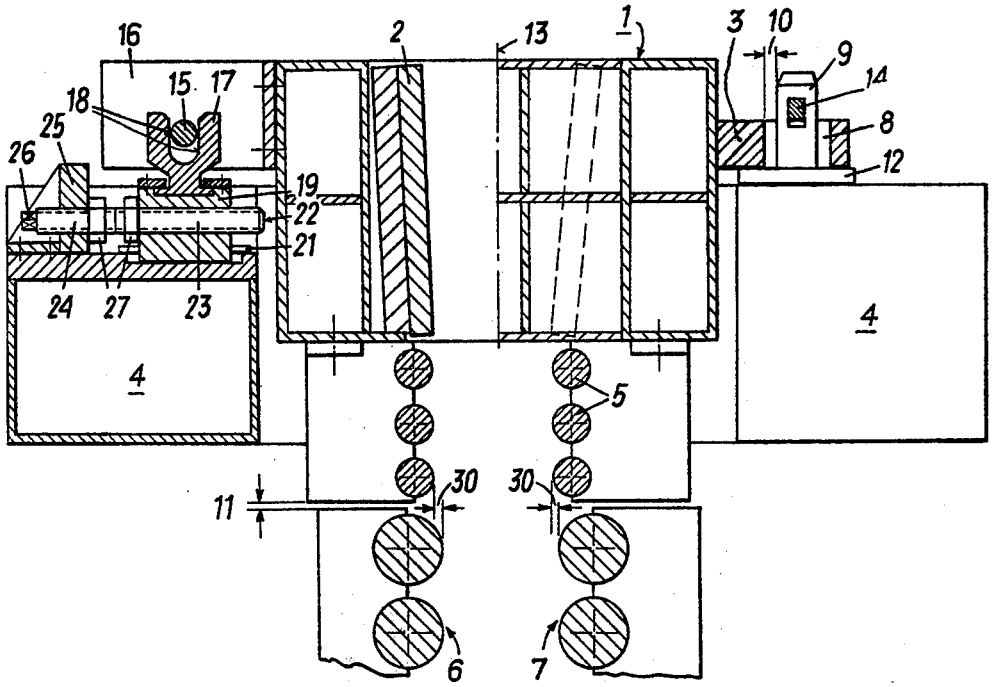
FIG. 2 is a section along line II—II of FIG. 1.
Figure 3:
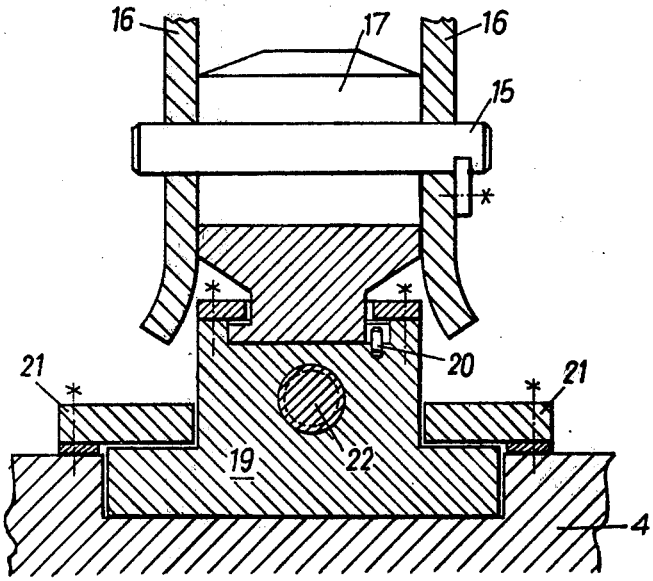
FIG. 3 shows a section along line III—III of FIG. 1.

FIG. 4 shows an embodiment, wherein bolts 29 having a crowned surface are inserted in the forks 17 and 17' instead of the bolts 15 of the embodiment illustrated in FIGS. 1 to 3. The greatest thickness of the bolts 29 corresponds to the distance between the guiding cheeks 18 of the forks. Due to the crowned surface of the bolts 29, inclined positions of the forks are compensated. According to this embodiment it is not necessary to mount the forks to be rotatable on the sliding block. Fork and sliding block may, e.g., be designed as one integral piece.

We claim:

1. In an arrangement for adjusting and securing a bottomless mould, including a water box, on a mould lifting table in a continuous casting plant for strand including supporting and guiding paths arranged to follow said mould to support the strand at opposite sides thereof, and sets of interacting centering means provided on the mould lifting table and on the mould for centering them with respect to each other, the improvement comprising:

displacement means for displacing one centering means of each set in a straight line direction perpendicular to the supporting and guiding paths so as to displace the mould perpendicular to the supporting and guiding path;

mounting means for mounting the mould with lateral play relative to the mould lifting table; and bracing means for fixing the mould on the mould lifting table.

2. An arrangement as set forth in claim 1, wherein the sets of interacting centering means comprise centering elements secured to the mould and centering-element-accommodating pieces provided on the mould lifting table, the centering elements engaging in the centering-element-accommodating pieces.

3. An arrangement as set forth in claim 2, wherein the centering-element-accommodating pieces are displaceable in a direction perpendicular to the supporting and guiding paths.

4. An arrangement as set forth in claim 2, wherein the centering elements are displaceable in a direction perpendicular to the supporting and guiding paths.

5. An arrangement as set forth in claim 1, further comprising exchangeable inserts provided between the mould and the mould lifting table for a height adjustment of the mould.

6. An arrangement as set forth in claim 1, wherein the mounting means for mounting the mould on the mould lifting table comprise brackets arranged on the periphery of the mould, drawing anchors arranged on the lifting table and penetrating said brackets with radial play; and wherein the bracing means comprise wedges insertable in slots in the drawing anchor so as to force the brackets against the lifting table.

7. An arrangement for adjusting and securing a bottomless rectangular mould, including a water box with two side walls and two end walls and foot rollers, on a mould lifting table in a continuous casting plant for strands, wherein supporting and guiding paths are arranged to follow the foot rollers of said mould to support the strand at opposite sides thereof, which comprises (a) four console-members with bores therein arranged at the corners of the water box to support said water box on said mould lifting table, (b) four drawing anchors rigidly secured to the mould lifting table and penetrating the bores of the console-members with radial play, (c) exchangeable spacers between the console-members and the mould lifting table for height-adjusting the mould, (d) two pairs of supporting plates arranged on one side wall of the water box, (e) two bolts, each carried by one pair of supporting plates, (f) two forks, each accommodating one bolt, and each having guiding cheeks extending substantially parallel to said supporting and guiding paths, (g) two sliding blocks mounting one fork each on said mould lifting table so as to be rotatable about a vertical axis, (h) guiding rails secured to the mould lifting table and extending perpendicular to the supporting and guiding paths for guiding said sliding blocks, and (i) threaded spindles extending parallel to said guiding rails and adapted to displace said sliding blocks.

8. An arrangement as set forth in claim 7, wherein each bolt as a diameter substantially corresponding to the distance between the guiding cheeks of the fork accommodating the bolt.

9. An arrangement as set forth in claim 7, wherein at least one bolt has a crowned surface, the widest diameter of said bolt substantially corresponding to the distance between the guiding cheeks of the fork accommodating the bolt.

10. An arrangement as set forth in claim 7, wherein of the two pairs of supporting plates one is guided without play on the fork allocated thereto and the second pair is guided with play on the second of the two forks.

11. In an arrangement for adjusting and securing a bottomless mould, including a water box, on a mould lifting table in a continuous casting plant for strands including supporting and guiding paths arranged to follow said mould to support the strand at opposite sides thereof, and sets of interacting centering means provided on the mould lifting table and on the mould for centering them with respect to each other, the improvement comprising:

displacement means for displacing one centering means of each set in a straight line direction perpendicular to the supporting and guiding paths so as to displace the mould parallel to the supporting and guiding path, said centering means including centering elements designed as bolts secured between pairs of supporting plates on the water box and centering-element-accommodating pieces designed forks having guiding cheeks, each bolt being insertable in the forks and having a diameter corresponding to the distance between the guiding cheeks of the forks;

means for mounting the mould with lateral play relative to the mould lifting table; and bracing means for fixing the mould on the mould lifting table.

12. An arrangement as set forth in claim 11, wherein a first fork is allocated to a first pair of supporting plates and a second fork is allocated to a second pair of supporting plates, said first fork and said second fork being so arranged on the mould lifting table that their guiding cheeks extend parallel to the supporting and guiding paths, said first pair of supporting plates being guided on said first fork without play and said second pair of supporting plates being guided on said second fork with play.

13. An arrangement as set forth in claim 12, further comprising guiding rails arranged on the mould lifting table, a first sliding block mounting said first fork on said lifting table, a second sliding block mounting said second fork on said lifting table, and a first threaded spindle and a second threaded spindle for moving said first sliding block and said second sliding block, respectively, along said guide rails.

14. An arrangement as set forth in claim 13, wherein said forks are mounted on said sliding blocks so as to be pivotable about a vertical axis.

15. An arrangement as set forth in claim 13, wherein at least one of said first fork and said second fork has inserted therein a bolt with a crowned surface, the widest diameter of the bolt corresponding to the distance between the guiding cheeks of the fork.

16. An arrangement as set forth in claim 11, wherein the bolts have crowned surfaces, whose greatest thickness corresponds to the distance between the guiding cheeks of the forks.

* * * * *

UNITED STATES PATENT OFFICE

CERTIFICATE OF CORRECTION

Patent No. 4,129,174 Dated Dec. 12, 1978

Inventor(s) Holleis et al.

It is certified that error appears in the above-identified patent and that said Letters Patent are hereby corrected as shown below:

Col. 3, line 41, delete "to".

Col. 4, line 4, "strand" should read --strands--.

Col. 5, line 10, "as" should read --has--;
last line, before "forks" insert --as--.

Signed and Sealed this
*Twelfth* Day of *June 1979*

[SEAL]

*Attest:*

RUTH C. MASON
*Attesting Officer*

DONALD W. BANNER
*Commissioner of Patents and Trademarks*